US006932639B2

(12) United States Patent
Woodruff

(10) Patent No.: US 6,932,639 B2
(45) Date of Patent: Aug. 23, 2005

(54) ELECTROLUMINESCENT CABLE CONNECTOR

(76) Inventor: George Woodruff, 61 E. Broad St., Titusville, FL (US) 32796

( * ) Notice: Subject to any disclaimer, the term of this patent is extended or adjusted under 35 U.S.C. 154(b) by 156 days.

(21) Appl. No.: 10/618,770

(22) Filed: Jul. 15, 2003

(65) Prior Publication Data

US 2005/0013563 A1 Jan. 20, 2005

(51) Int. Cl.[7] ..... H01R 4/24

(52) U.S. Cl. ..... 439/403; 439/581; 439/910; 439/698

(58) Field of Search ..... 439/403, 402, 439/401, 406, 407, 63, 581, 698, 910; 174/68.2, 70 B

(56) References Cited

U.S. PATENT DOCUMENTS 3,917,371 A * 11/1975 Hirokawa et al. ..... 439/52
4,921,451 A 5/1990 Carlson ..... 439/621
5,007,855 A 4/1991 O'Brien et al. ..... 439/411
5,055,071 A 10/1991 Carlson et al. ..... 439/621
5,567,173 A * 10/1996 Franckx ..... 439/418
5,702,262 A 12/1997 Brown et al. ..... 439/188
5,934,930 A * 8/1999 Camps et al. ..... 439/425
6,428,349 B1 * 8/2002 Dickson et al. ..... 439/513
6,666,713 B1 * 12/2003 Norvelle ..... 439/507
2002/0182934 A1 12/2002 Endo et al.

* cited by examiner

*Primary Examiner*—Hien Vu
(74) *Attorney, Agent, or Firm*—Richard C. Litman

(57) ABSTRACT

The electroluminescent cable (EL-cable) connector is a connector for mechanically and electrically splicing together a pair of EL-cables, each cable having a center conductor coated with an electroluminescent phosphor and two fine wires spiraling the length of the phosphor coating. The connector comprises an insulated base into which the EL-wires are inserted at opposite ends, passing through annular sleeves of conducting material, which interconnect the thin outer wires of the two EL-cables. An electrically conducting jumper disposed within an insulated cap has spaced forked protrusions for mechanically engaging and electrically connecting together the center conductors of the EL-cables when the cap nests within the base. Additional embodiments of the present invention include a connector for interconnecting an EL-cable to a pair of insulated wires and a third embodiment for mounting EL-cable to a printed circuit board.

4 Claims, 13 Drawing Sheets

ELECTROLUMINESCENT CABLE CONNECTOR

BACKGROUND OF THE INVENTION

1. Field of the Invention

The present invention relates to electrical cable connectors, and more particularly to a connector for electroluminescent cable having coaxial conductors.

2. Description of the Related Art

Electroluminescent cable (EL-cable) is a cool to the touch, bendable, vinyl coated wire that emits a pleasant 360-degree softly glowing neon light. EL-cable is a flexible wire cable having a solid copper center conductor surrounded by a material which is luminescent in an electric field. Two thin filaments or wires which are shorted together and helically wound around the luminescent material. The assembly is covered with one or two layers of vinyl or other plastic insulating material.

When an alternating current is conducted through the center conductor and the two filaments, the alternating electromagnetic field between the conductors causes the luminescent material to glow. Although the EL cable may be powered directly from the A.C. power mains, frequently the cable is powered by a D.C. inverter connected to a battery. The color emitted by the cable may vary with the frequency of the A.C. voltage or current. Usually the voltage must exceed a minimum threshold voltage before the EL-cable will glow.

EL technology is relatively new and only within the past few years has EL-cable become available in consumer products, specifically applications requiring lengths of glowing lights, applications which previously employed, LED or other lamp technologies. An efficient and effective method for connecting EL-cable either to other strands of EL-cable or to a pair of copper wires has not been adequately addressed.

In general, connectors for electric cables are not new and the technology is well represented by devices for splicing wires together and for connecting wires to electronic devices. U.S. Pat. No. 4,921,451, issued to R. Carlson in May of 1990, discloses in-line fuse holders for two-bladed fuses which can be fastened in series to an electrical wire by severing the wire in which the holder is to be incorporated, inserting the severed ends of the wire into the holder, and mechanically fastening the wire securely in the holder.

U.S. Pat. No. 5,007,855, issued to O'Brien et al. in 1991, discloses a cable connector having a pair of electrically conductive jumper elements with a pair of spaced sharp protrusions that are electrically connected. U.S. Pat. No. 5,055,071, issued to Carlson, deceased et al. in October of 1991, describes a cable connector in which two cables' conductors are each engaged by a slotted conductor, both of which engage with a common conducting bridge.

U.S. Pat. No. 5,702,262, issued to Brown et al. in December of 1997, discloses a housing having connectors in coaxial alignment with a pair of barrels. In U.S. patent application Publication No. 2002/0182934, published in December 2002, Endo et al. describes a coaxial connector having a central contact, an insulating housing, a grounding shell and a clamp. A crimp barrel serves as a conductor-connecting portion that is crimped into contact with the central conductor of the coaxial cable once the central conductor is inserted into the central contact.

None of the above inventions and patents, taken either singly or in combination, is seen to describe a connector for EL-cable as claimed. Thus a simplified electroluminescent cable connector solving the aforementioned problems is desired.

SUMMARY OF THE INVENTION

The electroluminescent cable connector is a connector for mechanically and electrically interconnecting a pair of electroluminescent (EL) cables, the EL-cable having a center copper conductor coated with an electroluminescent phosphor and two fine wires spiraling the length of the electroluminescent phosphor coating. The connector comprises an insulated base into which the cables are inserted at opposite ends through connecting and electrically conducting annular sleeves. The annular sleeves operate to interconnect the thin outer wires of one EL-cable to the corresponding thin outer wires of the second EL-cable. An electrically conducting jumper disposed within an insulating cap, has spaced forked protrusions, operating to mechanically engage and electrically connect the center conductors of the EL-cables when the cap nests within the base. Additional embodiments of the present invention include a connector for interconnecting a single EL-cable to a pair of insulated wires, and an electroluminescent cable connector for mounting EL-cable to a printed circuit board.

Accordingly, it is a principal object of the invention to provide a simple and easy connector for electroluminescent cable.

It is another object of the invention to provide a connector for electroluminescent cable that splices a pair of standard insulated wires to an electroluminescent cable.

It is a further object of the invention to provide a printed circuit board mountable electroluminescent cable connector.

Still another object of the invention is to provide an electroluminescent cable connector that is water resistant.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
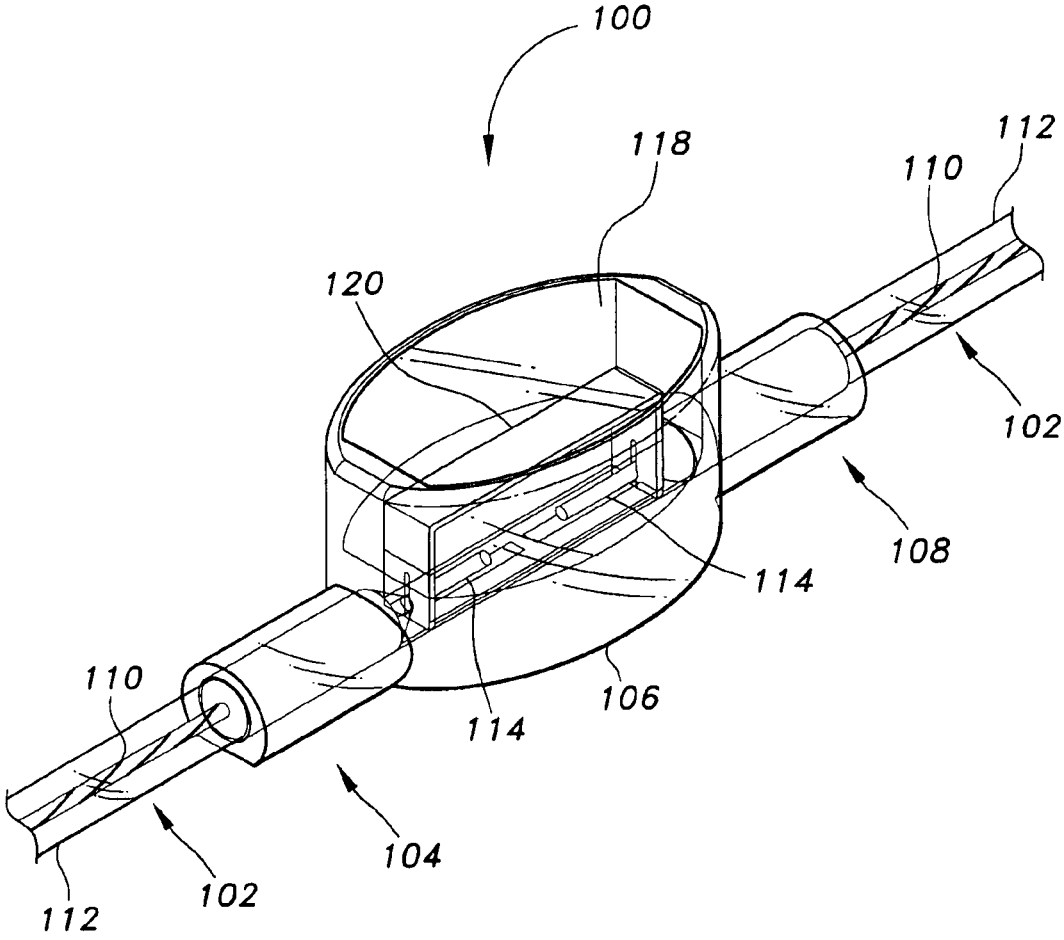
FIG. 1 is an environmental, perspective view of an electroluminescent cable connector interconnecting two electroluminescent cables according to the present invention.

The present invention is an electroluminescent (EL) cable connector designated generally as 100 in the drawings. The connector is designed for mechanically and electrically interconnecting two EL-cables. Alternative embodiments allow for connecting an EL-cable to a pair of insulated copper wires or to a printed circuit board. FIG. 1 illustrates the connector 100 electrically and mechanically connecting two EL-cables 102 received by openings disposed at opposite ends 104, 108 of the connector 100.

Figure 2A:
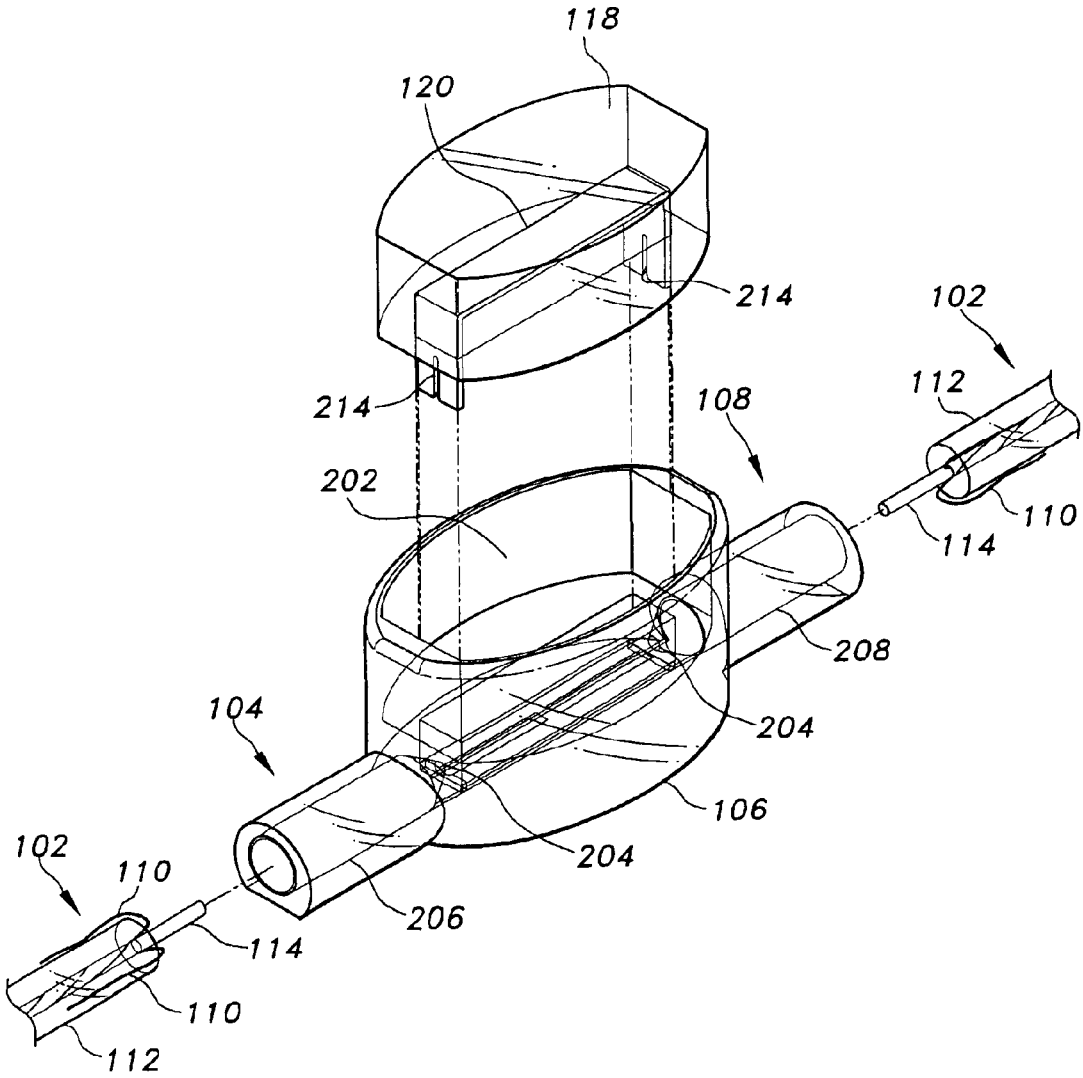
FIG. 2A is an exploded perspective view of the electroluminescent cable connector of FIG. 1.

As best shown in the exploded perspective view of FIG. 2, the connector 100 is comprised of a base 106 made of insulating material defining a centrally located cavity 202. The cavity 202 has orifices 204 disposed at the opposite ends of the cavity 202, which are sized to receive insulation stripped end portions of EL-cable 102, the diameter of the orifice 204 being less than the diameter of the insulated jacket 112 of the EL-cable 102.

Figure 2B:
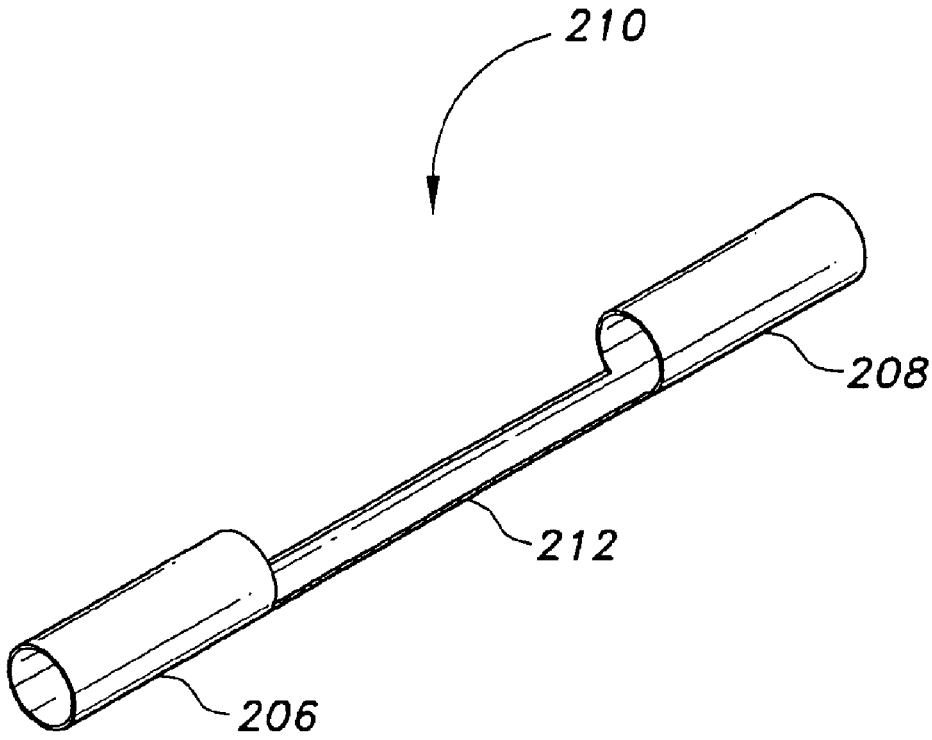
FIG. 2B is a perspective view of the conducting sleeve element of the electroluminescent cable connector according to the present invention.

An electrically conductive element 210, best shown in FIG. 2B, is encased within base 106. The conductive element 210 has a pair of spaced apart annular sleeves 206, 208 axially aligned with orifices 204, each annular sleeve 206, 208 sized to receive EL-wire 102. The annular sleeves 206, 208 operate to cooperatively engage and electrical connect the thin outer wires 110 of the two opposing EL-cables 102. The central bridging portion 212 of the conductive element 210 electrically connects the sleeves 206, 208 and is molded within base 106 beneath the floor of cavity 202.

As the structure and method for fastening the two EL-cables are identical, the following discussion will be limited to the structure and method for connecting one EL-cable 104 to the connector 100. In preparing EL-cable 102 for splicing, a short length of the insulating jacket(s) 112 is removed, revealing the thin outer wires 110 spiraling the length of the phosphor coated center conductor 114. The thin outer wires 110 are then folded back over the insulating jacket 112, whereupon the insulation free end of the EL-wire 102 is inserted into the annular sleeve 206 (or 208), through orifice 204, until the insulating jacket 112 abuts the tapered wall of the orifice 204.

When the EL-wire 102 is so received by annular sleeve 206, the folded back wires 110 are compressed between the inner surface of the annular sleeve 206 and the outer surface of the EL-wire's insulating jacket 112, thereby placing the thin wires 110 in electrical contact with sleeve 206. The same procedure is repeated for connecting the second EL-cable 102 to the opposite sleeve 208.

Figure 3:
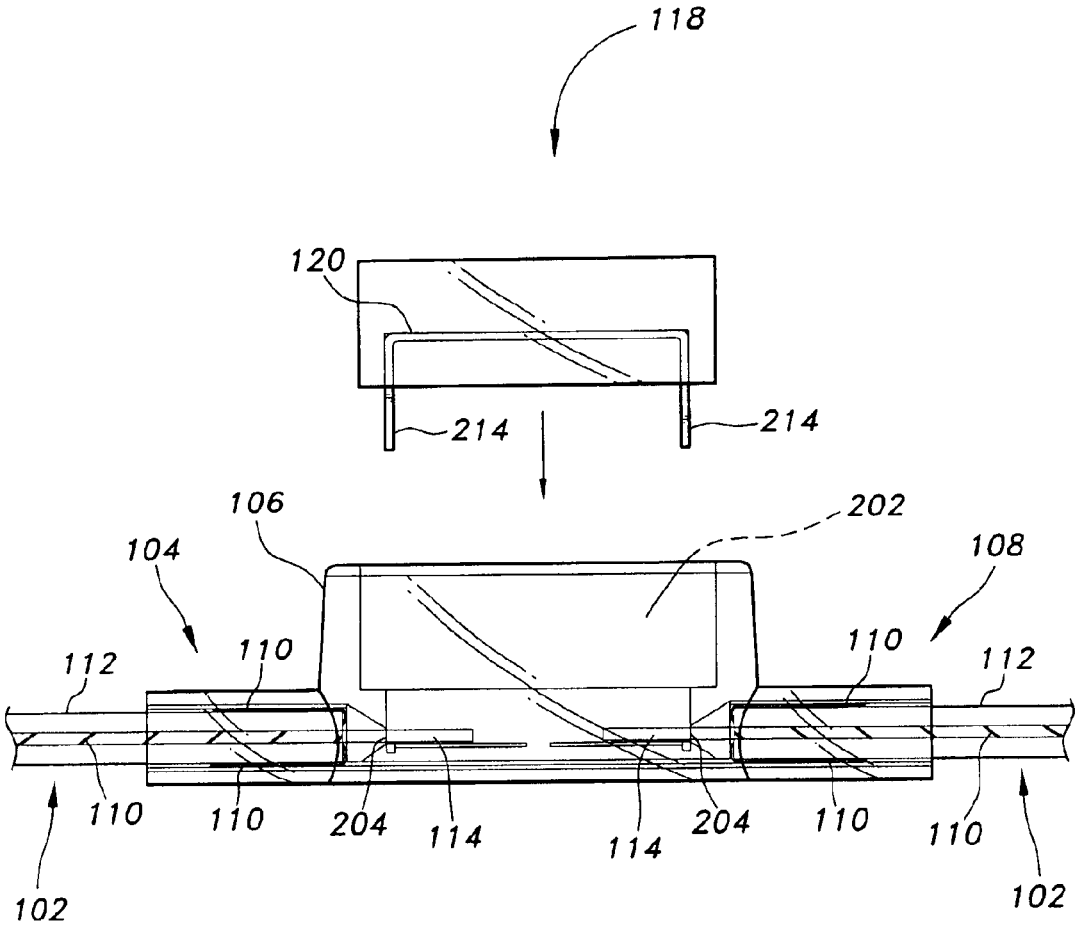
FIG. 3 is an exploded side view of the electroluminescent cable connector of FIG. 1 with the connector cap ready to be inserted into the body of the connector.

As shown in FIG. 3, a cap 118, formed of insulating material and sized fit within the base cavity 202, contains a recess for receiving an electrically conductive jumper element 120. The jumper element 120 has a pair of spaced apart forked protrusions 214, which pierce the phosphor coating of the EL-wire 102 and electrically and mechanically engage the center conductor of both EL-wires 102 when the cap 118 nests with the base 102. A measure of strain relief is provided by the forked protrusion 214 both wedging the center conductor 114 in the fork and piercing the phosphor coating on opposite sides of the center conductor 114.

Figure 4:
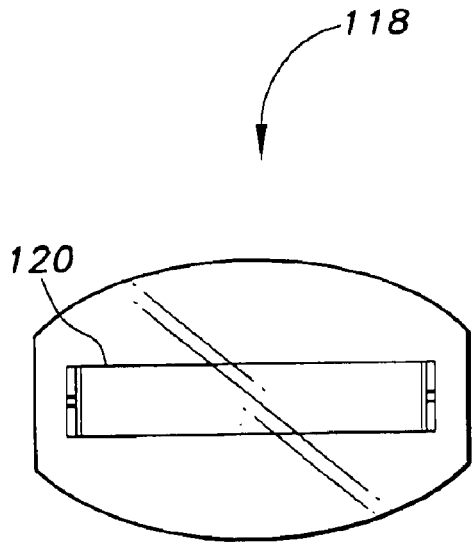
FIG. 4 is a top plan view of the connector cap of the electroluminescent cable connector of FIG. 1, showing the top of the conducting jumper element.
Figure 5:
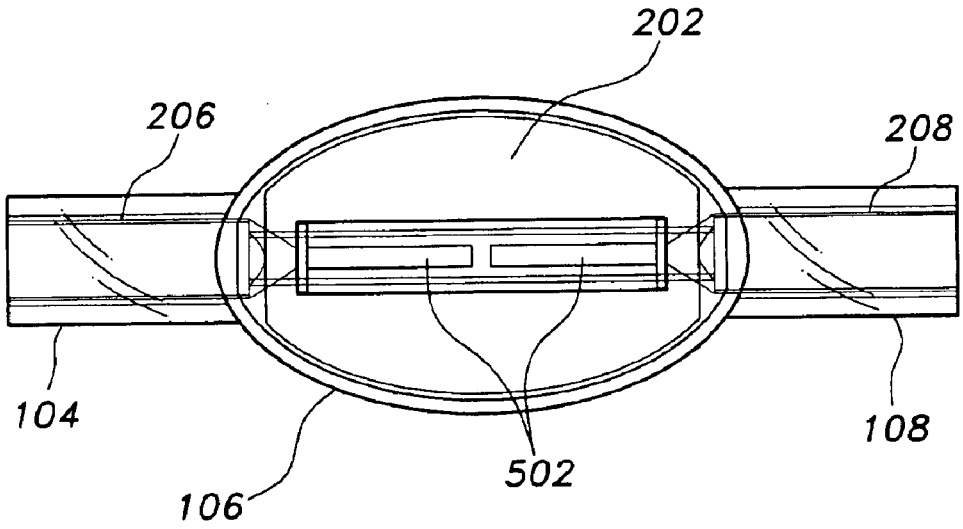
FIG. 5 is a top plan view of the base of the connector of the electroluminescent cable connector of FIG. 1, showing the inside of the cavity.

FIG. 4 shows a top plan view of the cap 118 with jumper element 120, the cap 118 being made of transparent material. FIG. 5 illustrates the top plan view of the connector base 106, the base 106 also being made of transparent material, showing the annular sleeves 206, 208 on both sides 104, 108 of the base 106. A pair of grooves 502 molded within the floor of the cavity operates as a stabilizing abutment surface for the stripped portion 114 of the EL-cables 102 when the cables 102 are pierced by the forked protrusions 214 of the cap's jumper element 120.

Figure 6:
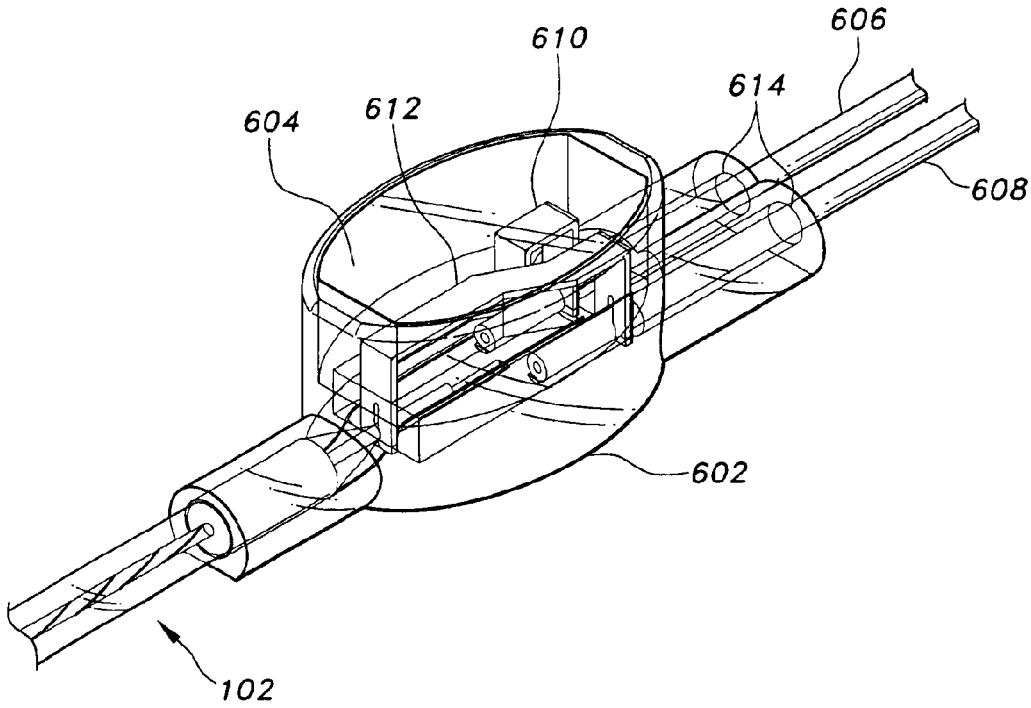
FIG. 6 is an environmental view of an electroluminescent connector according to the present invention splicing an electroluminescent cable to a pair of insulated wires.

A second embodiment of the present invention is illustrated in FIG. 6 and discloses a connector for connecting an EL-cable 102 to a pair of insulated wires 606, 608 of the variety well known to those in the art of electronics. This embodiment would be useful when attaching an EL-cable to a power source, the power source normally having an output consisting of a pair of insulated copper wires.

Figure 7A:
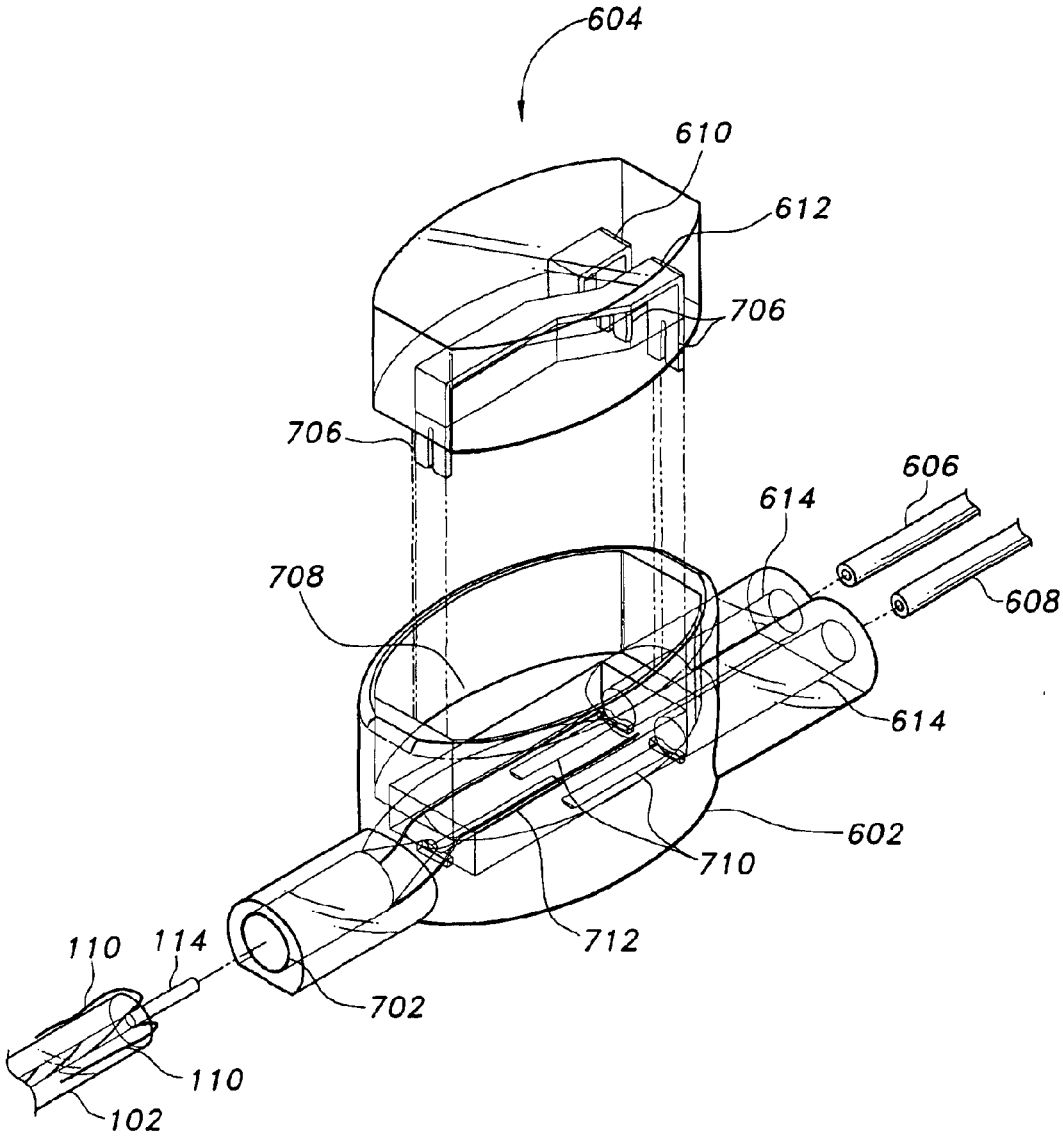
FIG. 7A is an exploded perspective view of the electroluminescent connector of FIG. 6.

As shown in FIGS. 6 and 7A, the EL-cable 102 is stripped and received by the annular sleeve 702 in a manner similar to that used for connecting EL-cable 102 to sleeve 206 as disclosed in reference to FIGS. 1–5 of the previous embodiment. In the present embodiment, however, the pair of insulated wires 606, 608 are received by molded passages 614 disposed at an end of the base 602 opposite the EL-wire 102. As shown in FIGS. 6 and 7A, a first and a second electrically conductive jumper element 612, 610 are recessed in cap 604. The first jumper element 612 has spaced apart and offset forked protrusions 706 adapted to simultaneously slice through the insulation of insulated wire 608 and grip the conductor encased in the insulation, while the forked protrusion 706 at the opposite end of jumper element 612 pierces the phosphor of EL-cable 102 and grips the center conductor 114 of the EL-cable 102 when the cap nests with the base 602, thereby electrically connecting wire 608 with the center conductor 114 of the EL-cable 102.

Figure 7B:
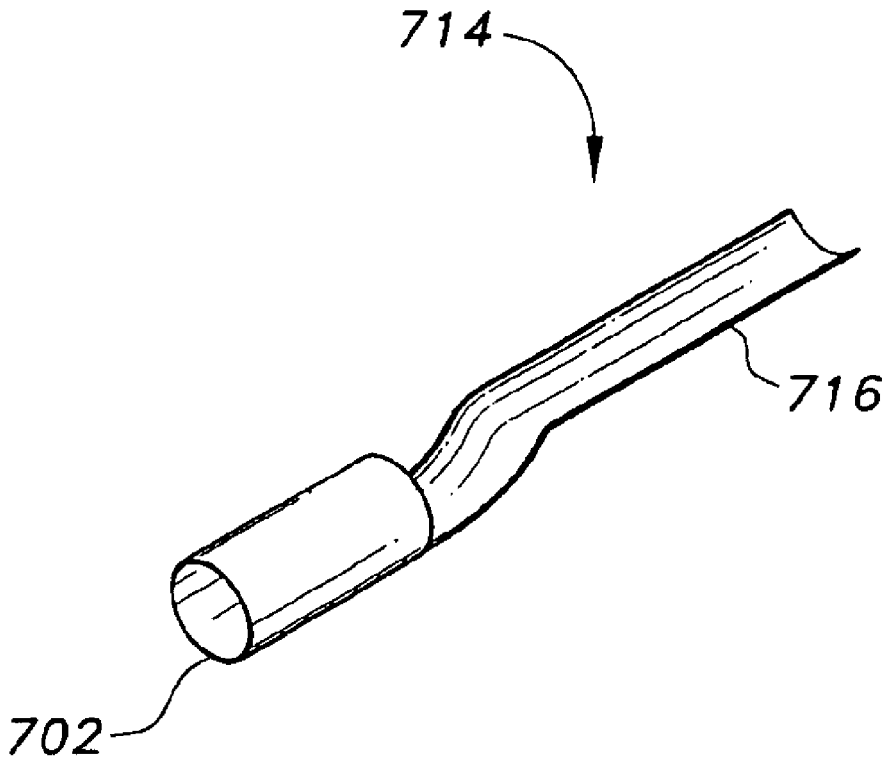
FIG. 7B is a perspective view of the conducting sleeve element of the electroluminescent connector of FIG. 6.

The second electrically conductive jumper 610 contained within cap 604 has a single forked protrusion 706 adapted to slice through the insulation of the second wire 606, and grip the conductive wire 606, continuing onward to penetrate the floor of the base 602 to make electrical contact with an offset extension 716 (seen in FIG. 7B) of the jumper 714, thereby electrically connecting wire 606 with annular sleeve 702 and the two thin wires wrapped around the phosphor of EL-cable 102.

Figure 8:
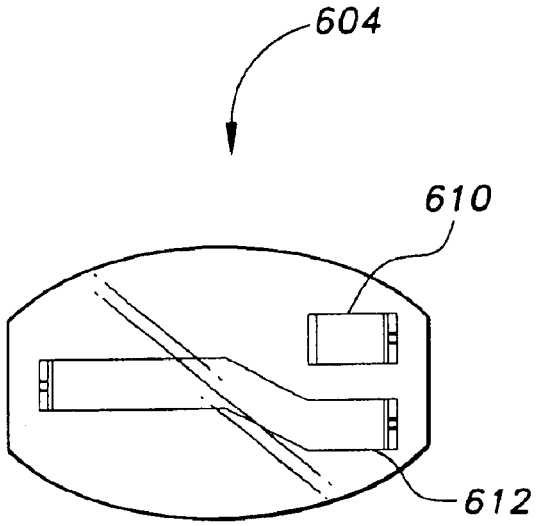
FIG. 8 is a top plan view of the connector cap of the electroluminescent connector of FIG. 6, showing two jumper elements.
Figure 9:
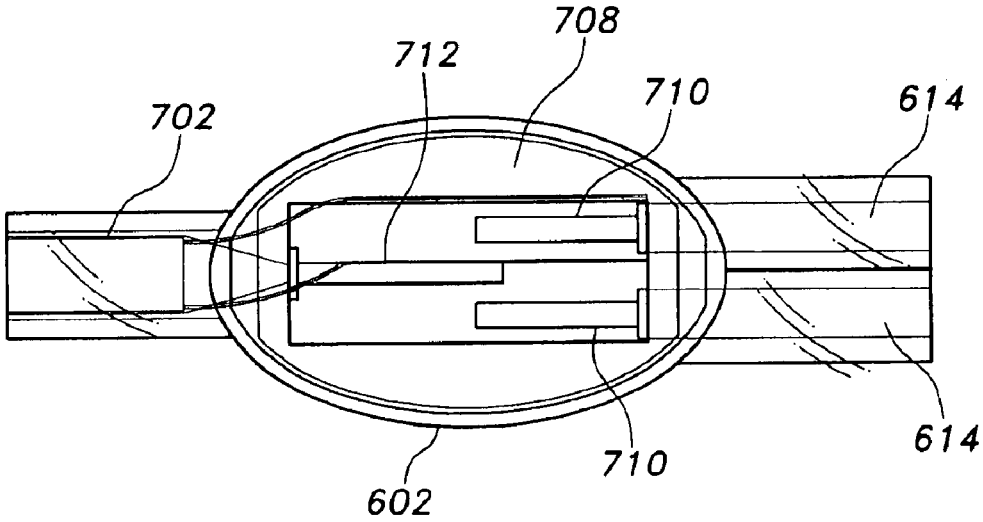
FIG. 9 is a top plan view of the connector base of the electroluminescent connector of FIG. 6, showing the inside of the base cavity.

FIG. 8 shows the top plan views of the cap 604 having the two conducting jumpers 612 and 610, the cap 604 being made of a transparent material. FIG. 9 is a top plan view of the base 602, the base 602 being transparent, and illustrates groove 712 molded in the floor of the cavity 708 stabilizing the phosphor coated center conductor of the EL-cable 102, while a pair of grooves 710 provide stable surfaces for piercing the insulation of the two insulated wires 606, 608 when the cap 604 is firmly nested within the base 602.

Figure 10A:
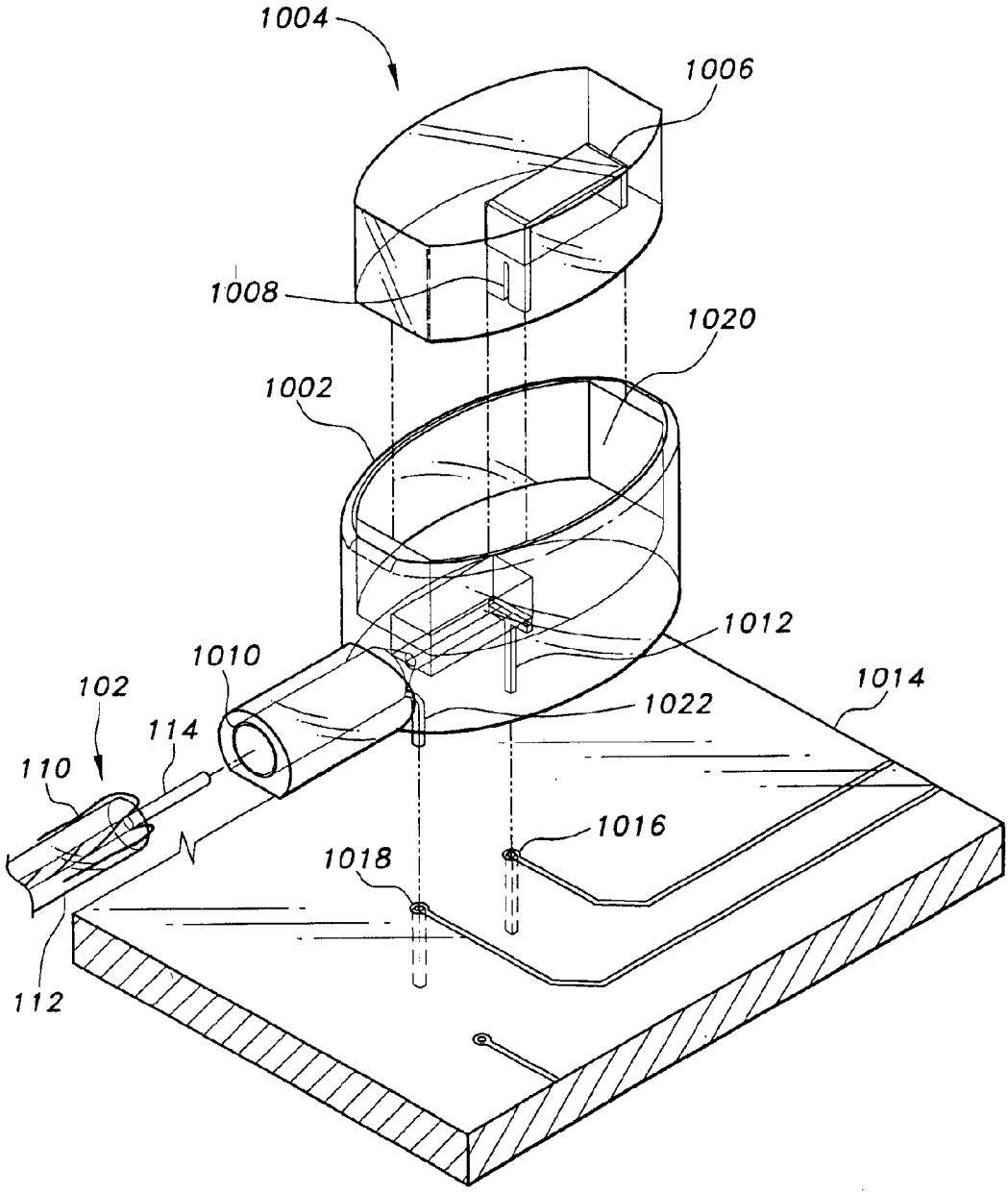
FIG. 10A is an exploded environmental view of a printed circuit board mountable electroluminescent cable connector according to the present invention.
Figure 11:
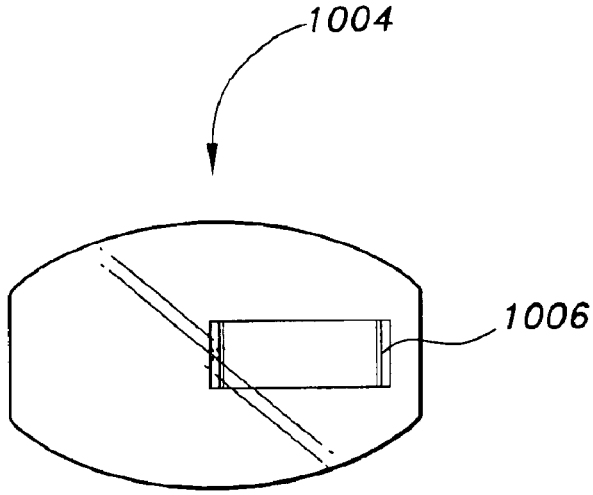
FIG. 11 is a top plan view of the connector cap of the electroluminescent connector of FIG. 10A.
Figure 12:
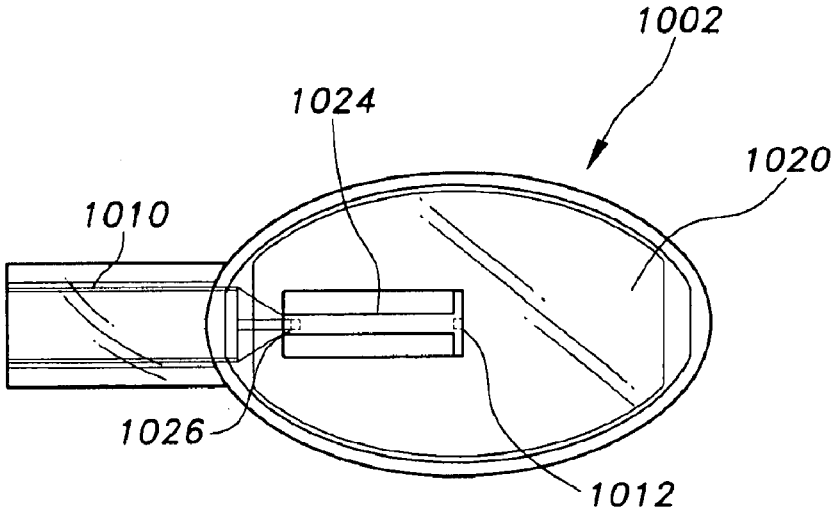
FIG. 12 is a top plan view of the connector base and cavity of the electroluminescent connector of FIG. 10A.

In many applications, electronic cables must terminate directly on a printed circuit board, the conductors being in electrical contact with conducting pins that are received by plated through-holes in the printed circuit board and secured in place by solder or other means. The printed circuit board mountable EL-cable connector shown in FIG. 10A involves a third embodiment of the present invention and builds upon the basic structure of the first two embodiments. This basic structure includes: a base 1002 having a cavity 1020 and a conducting annular sleeve 1010; and a cap 1004 sized to the cavity 1020, having a conducting element 1006 with a forked protrusion 1008. The printed circuit board mountable connector further comprises terminal pins 1012, 1022 for placement in plated through-holes 1016, 1018 of a printed circuit board 1014. The transparent cap 1004 and single conducting element 1006 is shown in FIG. 11 and as previously disclosed, mates with the cavity 1020 molded in the base 1002. As shown in FIG. 12, orifice 1026 is molded in the base and operates to guide the phosphor coated center conductor 114 into the cavity 1020 along groove 1024, the orifice forming a stop for the insulating jacket 112.

Figure 10B:
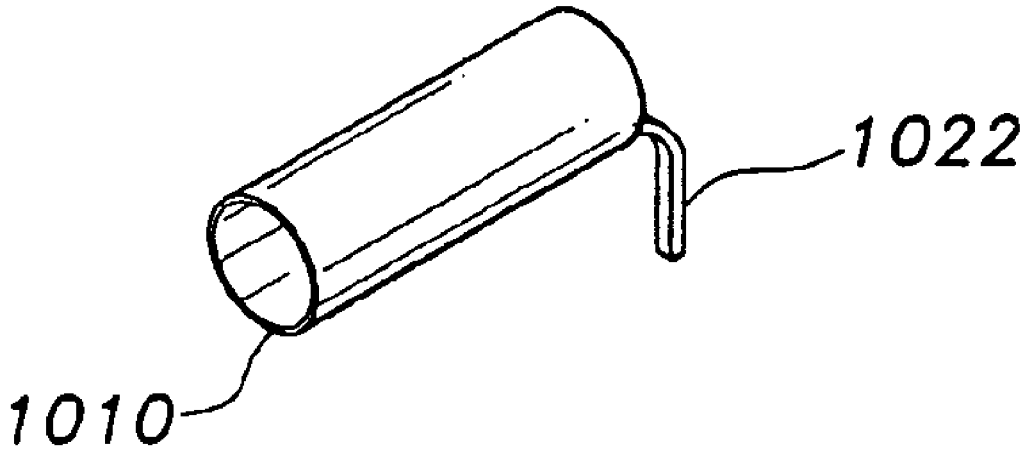
FIG. 10B is a perspective view of the conducting sleeve element with printed circuit board contact of the electroluminescent connector of FIG. 10A.
Figure 13:
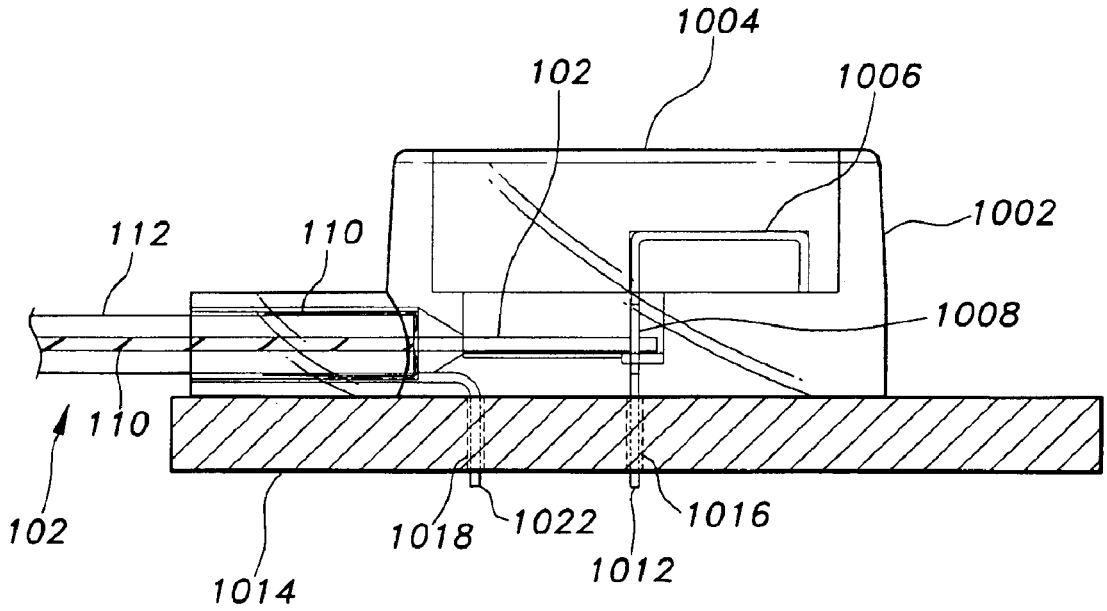
FIG. 13 is a side elevation view of the electroluminescent connector of FIG. 10A.

As shown in FIGS. 10B and 13, pin 1022 is formed integrally with sleeve 1010, the sleeve 1010 being molded into the base 1002 and the pin 1022 extending normal to the sleeve 1010 and through the bottom of the base 1002 so that it can be inserted through the hole 1018 and soldered to the printed circuit board, thereby establishing electrical contact between the two thin wires 110 wrapped around the phosphor of EL-cable 102 and printed circuit board 1014. The center conductor 114 is gripped by forked protrusion 1008, which penetrates the floor of base 1002 to make electrical contact with the top of pin 1012, which extends through the base 1002 so that pin 1012 can be inserted through hole 1016 and soldered to printed circuit board 1014, thereby establishing electrical contact between the center conductor 114 of EL-cable 102 and printed circuit board 1014.

I claim:

1. An electroluminescent cable connector for mechanically and electrically interconnecting a pair of electroluminescent cables, each electroluminescent cable having concentric layers, a center conductor, a coating of electroluminescent phosphor disposed around the center conductor, two very thin outer wires wrapped around the phosphor, and at least one insulating jacket covering the outer wires and phosphor, the electroluminescent cable connector comprising:

a base defining a centrally located cavity, the cavity having orifices disposed at opposite ends of the base, each of the orifices being adapted for receiving an end portion of the center conductor of one of the electroluminescent cables stripped of the insulating jacket;

a first electrically conductive jumper element encased within said base, the conductive jumper element having a pair of spaced annular sleeves and a central bridging element electrically and mechanically connecting the sleeves, the sleeves being axially aligned with the orifices, each of the annular sleeves being adapted for receiving an electroluminescent cable with the thin outer wires of the cables being folded back over the insulating jacket, whereby the annular sleeve is in electrical contact with the thin outer wires of the electroluminescent cable;

a second electrically conductive jumper element having means for electrically and mechanically gripping and connecting the center conductors of both of the electroluminescent cables; and a cap formed of insulating material disposed in and covering the cavity defined by the base, the cap having a recess defined therein, the second electrically conductive jumper element being disposed in the recess.

2. The electroluminescent cable connector according to claim 1, wherein said means for electrically and mechanically gripping and connecting the center conductors of both said electroluminescent cables comprises a pair of spaced forked protrusions disposed on said second conductive jumper element, the forked protrusions being adapted for piercing the phosphor coating and gripping the center conductors when the cap nests within the cavity defined in said base.

3. The electroluminescent cable connector according to claim 1, further comprising a waterproof sealant securing said cap within the cavity of said base.

4. The electroluminescent cable connector according to claim 1, wherein said cap and said base are molded of transparent colored plastic.

* * * * *